US007893843B2

(12) United States Patent
Bischoff

(10) Patent No.: US 7,893,843 B2
(45) Date of Patent: Feb. 22, 2011

(54) ACTIVITY WINDOWING

(75) Inventor: Brian J. Bischoff, Red Wing, MN (US)

(73) Assignee: Healthsense, Inc., Mendota Heights, MN (US)

( * ) Notice: Subject to any disclaimer, the term of this patent is extended or adjusted under 35 U.S.C. 154(b) by 433 days.

(21) Appl. No.: 12/141,471

(22) Filed: Jun. 18, 2008

(65) Prior Publication Data

US 2009/0315733 A1 Dec. 24, 2009

(51) Int. Cl.
*G08B 13/14* (2006.01)

(52) U.S. Cl. ..... 340/573.1; 340/573.4; 340/539.13; 340/539.23; 340/522; 340/523; 340/529; 340/540; 340/541; 600/483; 600/490; 600/595; 705/2; 705/11

(58) Field of Classification Search ..... 340/573.1, 340/573.4, 539.11, 539.23, 522, 523, 529, 340/540, 541; 600/483, 490, 595, 836; 705/2, 705/11

See application file for complete search history.

(56) References Cited

U.S. PATENT DOCUMENTS 4,259,548 A 3/1981 Fahey et al.
5,204,670 A 4/1993 Stinton
5,544,649 A 8/1996 David et al.
6,297,738 B1 10/2001 Newham
6,989,753 B1 1/2006 Lamming et al.
7,141,026 B2 11/2006 Aminian et al.
2003/0117279 A1* 6/2003 Ueno et al. ..... 340/523
2005/0131736 A1 6/2005 Nelson et al.
2005/0137465 A1* 6/2005 Cuddihy et al. ..... 600/300
2007/0085690 A1 4/2007 Tran
2007/0152811 A1 7/2007 Anderson
2007/0152837 A1 7/2007 Bischoff et al.
2007/0192174 A1 8/2007 Bischoff

* cited by examiner

*Primary Examiner*—Tai T Nguyen
(74) *Attorney, Agent, or Firm*—Brooks, Cameron & Huebsch, PLLC

(57) ABSTRACT

Methods, devices, and systems for monitoring a number of recurrent activities of an individual are disclosed. One method for monitoring a recurrent activity of an individual using activity windowing includes recording a number of sensor activations of at least one sensor, determining a number of peaks in the number of sensor activations, defining one or more time frames based upon the location of at least one of the number of peaks in the time period, and applying a rule associated with a threshold number of activations, where the rule is applied to at least one particular time frame in order to determine whether to initiate an action.

19 Claims, 3 Drawing Sheets

ACTIVITY WINDOWING

BACKGROUND

Sensing systems have been developed that use sensors to monitor an individual within a residence. Such systems may set thresholds for certain types of activity, such as eating or showering. However, not all individuals operate on the same schedule and accordingly, some individual's activities may fall outside a range of number of sensor activations and/or time period for doing certain tasks.

For example, a system may expect eating to occur at 8:00 to 9:00 a.m., 11:00 a.m. to 1:00 p.m., and at 4:30 p.m. to 7:00 p.m., but an individual may eat only two meals a day at 10:00 to 10:30 and at 3:00 to 3:30. In such a situation, some systems may initiate an alert if there is no activity during the 8:00 to 9:00 time period even though that time period is not part of the particular individual's schedule.

Further, when a lack of movement or abnormal amount of movement is indicated, the sensing system may report the situation to a remote assistance center that may, for instance, contact a party to provide aid to the individual. However, not all such activity events indicate that the individual is in need of assistance.

For instance, the individual may be sitting in a chair or lying in bed for a prolonged period. These periods may, in some systems, be sufficient to initiate an alert for third party response, but may not actually be an emergency.

Hence, there may be uncertainties related to the sensor activations of such systems and/or related to the determinations of whether to initiate an action, for instance, based upon the reliability of signals from individual sensors. Further uncertainties may arise from analysis of all such sensor activations during an extended time period.

DETAILED DESCRIPTION OF THE DISCLOSURE

Figure 1:
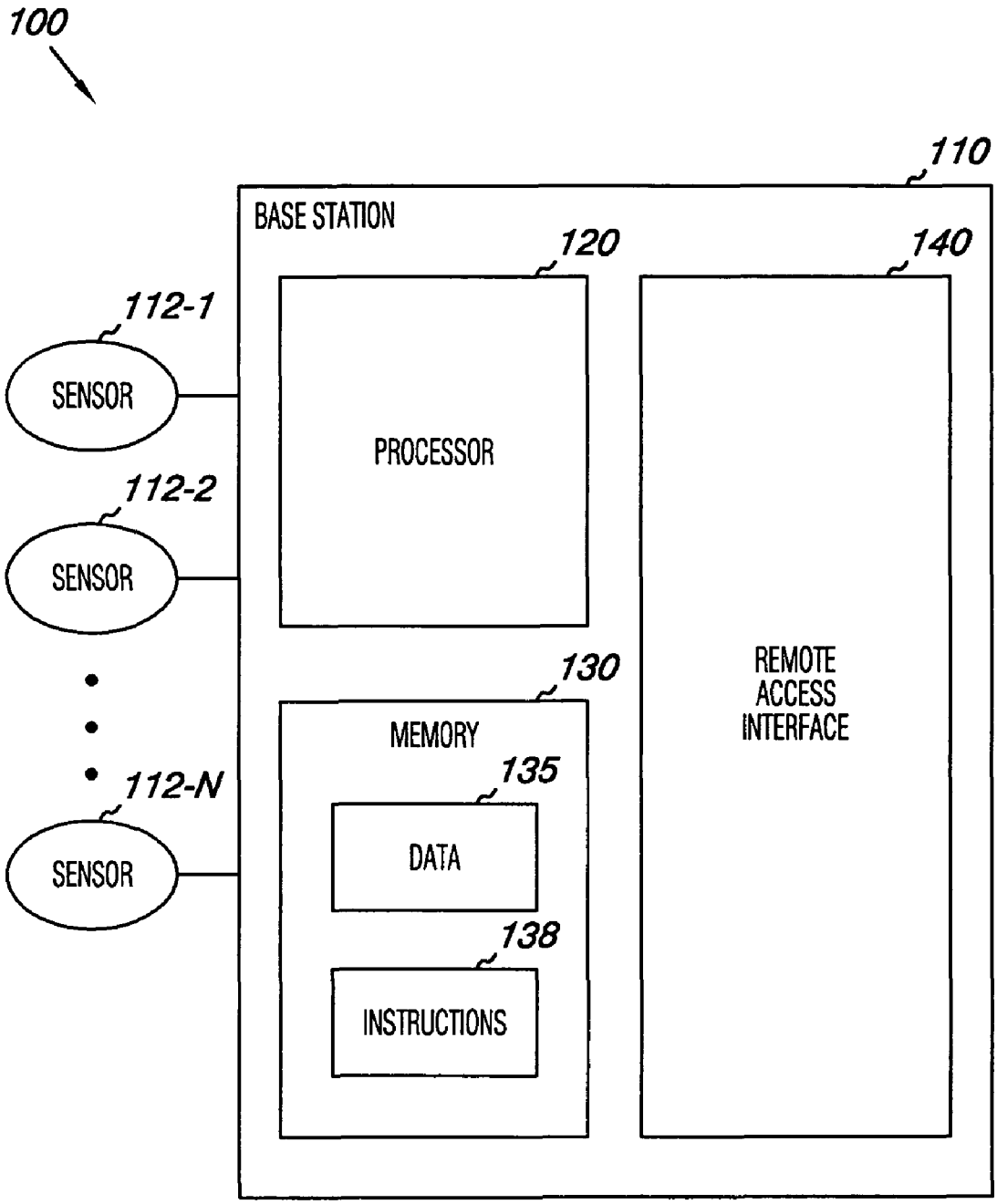
FIG. 1 illustrates an embodiment of a monitoring system according to the present disclosure.

Embodiments of the present disclosure can provide simple, cost effective, privacy-respecting, and/or relatively non-intrusive methods, devices, and/or systems for monitoring performance of recurrent activities of an individual using activity windowing. Embodiments of the present disclosure, for example, can be utilized with and can include systems, devices, and methods as described in U.S. application Ser. No. 11/323,077, filed Dec. 20, 2005, U.S. application Ser. No. 11/361,872, filed Feb. 24, 2006, and U.S. application Ser. No. 11/788,178, filed Apr. 19, 2007. The present disclosure provides activity performance monitoring concepts that can be used with the systems discussed in the above referenced applications, the present disclosure, and/or other systems for monitoring one or more individuals in various locations, which, in some embodiments, can include a residence in which the individual dwells long-term and/or short-term.

For instance, embodiments can include systems, methods, and devices to monitor the activity of an individual within or around a residence. As used herein, a "residence" can, for instance, be a house, dwelling, condominium, townhouse, apartment, and/or an institution (e.g., a hospital, assisted living facility, nursing home, and/or prison, among others). Various embodiments of the present disclosure can, for example, monitor an individual's performance of activities within and/or around such a residence.

According to the present disclosure, methods, devices, and systems are provided for monitoring a number of recurrent activities of an individual. Among various embodiments, activity windowing can be used to record a number of sensor activations of at least one sensor, determine a number of peaks in the number of sensor activations, and define one or more time frames based upon the location of at least one of the number of peaks in a time period. In various embodiments, a rule can be applied that is associated with a threshold number of activations, where the rule is applied to at least one particular time frame in order to determine whether to initiate an action.

The figures in the present disclosure follow a numbering convention in which the first digit or digits correspond to the drawing figure number and the remaining digits identify an element or component in the drawing. As will be appreciated, elements shown in the various embodiments herein can be added, exchanged, and/or eliminated so as to provide a number of additional embodiments of value.

FIG. 1 illustrates an embodiment of a monitoring system according to the present disclosure. The embodiment of the system 100 illustrated in FIG. 1 shows a base station 110 to monitor the activities of an individual (e.g., a client) in and/or around a residence through use of a number of sensors 112-1, 112-2 . . . 112-N.

The base station 110 can also initiate a number of actions based upon a number of rules implemented by the base station 110. These rules can, in various embodiments, be applied by a processor 120 and/or one or more other logic components to use the information obtained from the number of sensors to determine whether or not to initiate an action.

The base station 110 can include a number of other components that enable performing a number of functions, as described in the present disclosure. In the embodiment shown in FIG. 1, the processor 120 can operate using a memory 130 from which data 135 (e.g., input from the sensors 112-1, 112-2 . . . 112-N and/or provided thereon) and instructions 138 (e.g., rules and/or operating instructions) can be accessed in order to determine what actions to initiate. The memory 130 can be RAM, ROM, Flash, and/or other types of memory. The base station can also include components such as a clock, input/output functionality, firmware, hardware, and/or an application-specific integrated circuit (ASIC), among other suitable components.

As shown in the embodiment illustrated in FIG. 1, the system can include a remote access interface 140 and/or a local interface (not shown), which are accessible by a client (e.g., an individual whose activities are being monitored). Communications between the base station 110, the sensors 112-1, 112-2 . . . 112-N, the remote access interface 140, and/or the local interface can be accomplished in various manners. For example, in the embodiment shown in FIG. 1, the communications can be accomplished by wired (e.g., a telephone line) and/or wireless (e.g., a radio interface) communications.

However, lifestyles of various individuals can greatly differ. Although it may be unlikely for an individual to, for instance, enter the kitchen for the purpose of eating from 1:00-3:00 a.m., when considering a whole population, some particular individuals may, for various reasons, prefer to take nourishment in that time frame.

Hence, in order to determine which time frames are most appropriate for monitoring a particular activity for the particular individual being monitored, a baseline measurement of a frequency of activation of the particular sensors for the particular activity can be acquired over a particular time period. For instance, power may be continuously provided to the sensors in the kitchen concerned with monitoring the individual's activities related to taking nourishment for a defined time period (e.g., a month) in order to acquire a representative sampling of times (e.g., using a 24-hour clock) in each day that the individual performs activities related to taking nourishment.

Figure 2:
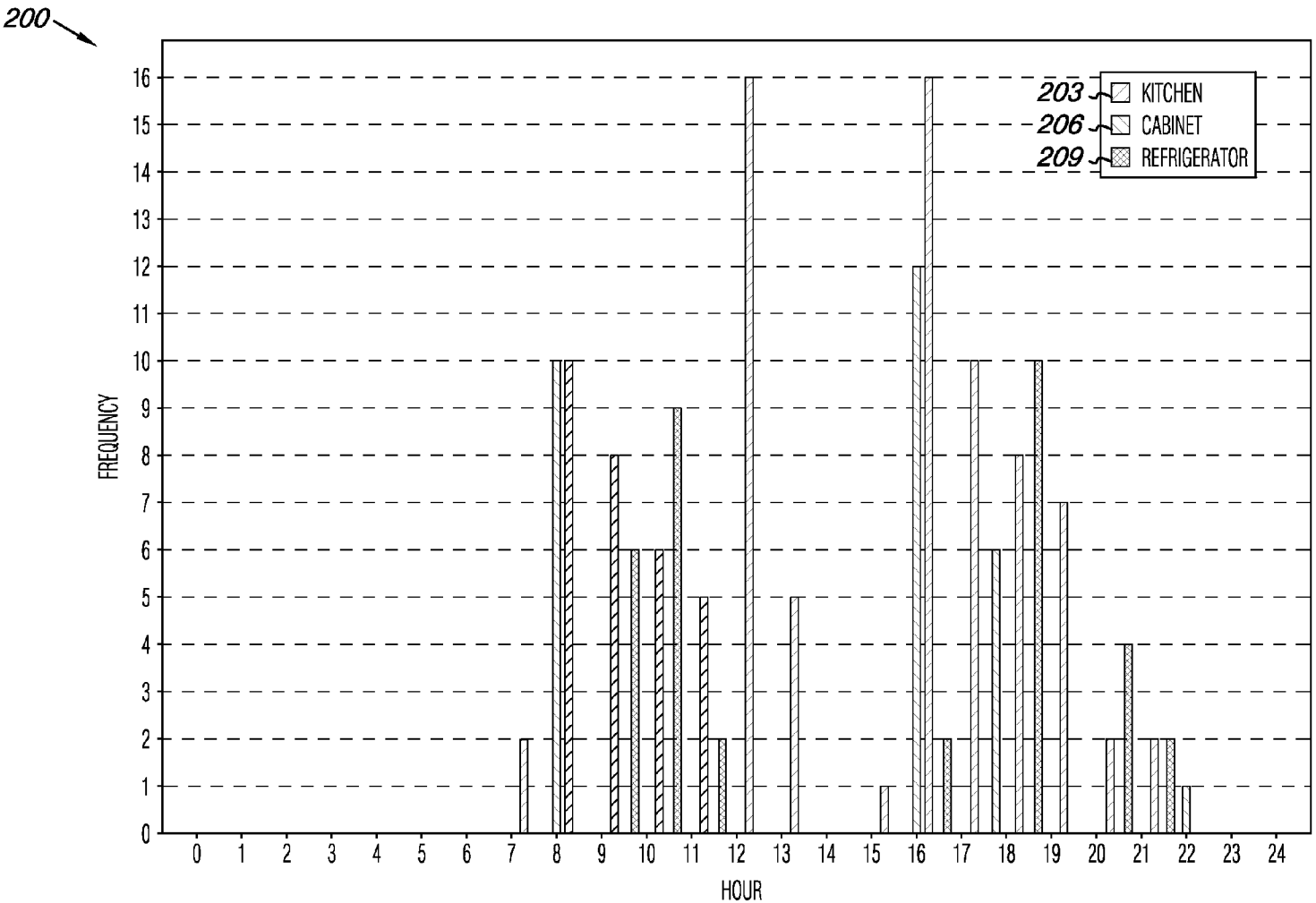
FIG. 2 illustrates a representation of sensor activation frequency allocated to particular time frames according to the present disclosure.

Acquiring such a representative sampling can allow numerical (e.g., graphic, statistical, etc.) analysis of a frequency of activities related to, for example, eating, where the frequency in a particular day can be divided into in a sequence of time frames throughout the day (e.g., 0:01 to 1:00, 1:01 to 2:00, 2:01 to 3:00, through 23:01 to 24:00 in a day measured using a 24-hour clock). For example, as illustrated in FIG. 2, by way of example and not by way of limitation, a graph can be constructed in which the frequency of sensor activations is recorded on a first axis and the time frame during which the individual sensor activations occurred is recorded on a second axis (e.g., that is divided into hour-long time frames, although other timeframes could be used). Recording the frequency of sensor activations during particular time frames long enough to acquire a representative sampling can allow determination of when a particular activity is more likely to be performed (e.g., time frames in a day) by a particular individual, which may be notably different from when such an activity is performed by other individuals.

As discussed above, FIG. 2 illustrates a representation of sensor activation frequency allocated to particular time frames according to the present disclosure. In some embodiments of the present disclosure, a graphical display can be used to represent sensor activation frequency allocated to particular time frames.

The graph 200 illustrated in FIG. 2 shows, on a vertical axis, the frequency (e.g., a cumulative integer) of sensor activations related to detection of indicators of an individual performing a particular recurrent activity. A horizontal axis of the graph 200 is divided into a sequence of time frames to which each sensor activation can be allocated. For example, the horizontal axis shown in FIG. 2 can be divided into 24 hour-long time frames representing a single day (e.g., running from just after midnight of the preceding day to midnight of the represented day).

Sensor activations accumulated over a defined time period (e.g., a week, a month, a year, etc.) can, in various embodiments, be allocated to, for example, the 24 hour-long sequential time frames representing a single day, as shown in FIG. 2, in order to acquire a statistically representative sampling. The representative sampling can be analyzed to determine in which one or more time frames the individual is more likely to perform the activity and/or in which one or more time frames the individual is less likely to perform the activity.

In some embodiments, a number of different sensors can be included in a group of sensors that each detects a different indicator that can be associated with performing a particular activity. For example, a number of different actions can be associated with an individual taking nourishment during a day. In some situations, each of the different actions can be included or excluded at the discretion of the individual (i.e., optionally performed) depending upon, for example, how the individual intends to prepare the nourishment, what the individual intends to eat and/or drink, and/or where the nourishment is stored, among other considerations.

The example illustrated in the graph 200 shows frequencies of activation of a group of sensors, where activation of each type of sensor in the group can represent optional actions performed by an individual intending to take nourishment. For example, in some embodiments, detecting a frequency of an individual's presence in the kitchen with a sensor of an indicator 203, detecting a frequency of an individual opening a cabinet where food is stored with a sensor of an indicator 206, and detecting a frequency of an individual opening a refrigerator with a sensor of an indicator 209, as illustrated in FIG. 2, can be used as a group of sensors for monitoring nourishment of the individual.

Each of the actions of being in the kitchen 203, opening the cabinet 206, and opening the refrigerator 209 can be optionally performed by the individual living in the residence intending to eat and/or drink something during a particular time frame in a day. Moreover, some actions (e.g., being in the kitchen) may sometimes be unrelated to taking nourishment (e.g., washing the dishes, cleaning the stove, answering a telephone call, putting away groceries, etc.). In addition, sometimes a particular action may be performed by an individual other than the individual living in the residence whose activities are being monitored (e.g., a visitor may enter the kitchen).

However, combined analysis of the actions detected by a group of sensors can provide a more sensitive and/or a more robust indication of the frequency of the individual being monitored performing the recurrent activity, in some situations. That is, the more activations of sensors detecting different actions associated with performance of a particular activity that occur in a particular time frame and/or contiguous time frames, the more reliable the determination that the particular activity is being performed by the individual being monitored in the residence.

Conversely, if an indicator of one action (e.g., being in the kitchen) is detected with high frequency (e.g., in a particular time frame and/or throughout various time frames) in isolation from other actions detected by the group of sensors, the individual may not be performing the activity being monitored. For example, the individual may have a telephone in the kitchen and may make and/or receive calls at a particular time of day and/or at various times throughout the day.

The graph 200 illustrated in FIG. 2 shows that an indicator of an individual being in the kitchen has activated the appropriate sensor 203 such that frequencies of such activations have been recorded in time frames spread from around the 7 time frame (e.g., from 7:01 a.m. to 8:00 a.m.) to the 21 time frame (e.g., 9:01 p.m. to 10:00 p.m.). The heights of the bars representing individual frequencies of sensor activations in particular time frames vary from, for example, the 7 time frame (i.e., a frequency of 2 activations) to the 12 time frame (i.e., a frequency of 16 activations) to the 21 time frame (i.e., a frequency of 2 activations) to indicate that the frequency of visits to the kitchen by an individual correspondingly vary.

As illustrated in FIG. 2, multiple sensors can, in various embodiments, be combined in a group of sensors to monitor indicators of actions that can optionally be included while performing a particular recurrent activity. For example, as shown in graph 200, one or more sensors that detect indicators of one or more cabinets being opened 206 (e.g., where various types of nourishment are stored) can be combined with the one or more sensors that detect the presence of an individual in the kitchen 203. One or more sensors that detect one or more indicators of a refrigerator being opened 209 (e.g., where various types of nourishment are being cooled and/or frozen) also can be combined with the one or more sensors that detect the presence of an individual in the kitchen 203 and the one or more sensors that detect indicators of one or more cabinets being opened 206.

The three types of sensors (i.e., 203, 206, and 209) illustrated in graph 200 are shown by way of example and not by way of limitation. That is, monitoring of an individual taking nourishment can be accomplished using more or less types of sensors than shown in graph 200. Similarly, the monitoring of any other recurrent activity performed by the individual can be accomplished using more or less types of sensors than shown in graph 200.

Detection of performance of a recurrent activity using a combination of multiple sensors of various actions that can optionally be performed by an individual while performing the recurrent activity over an representative, defiled time period can provide a reliable indication of when during a typical day a particular recurrent activity is performed. For example, as shown in the illustration in graph 200, the individual being monitored performed, during the defined time period, actions having indicators that activated sensors for being in the kitchen 203, opening a cabinet 206, and/or opening a refrigerator 209 at least twice (e.g., which can serve as a threshold value for consideration) during the time frames from hour 7 through hour 13. Additionally, the individual being monitored performed actions having indicators that activated such sensors at least twice during the time frames from hour 16 through hour 21.

In some embodiments, analysis of such actions to further define when the activity being monitored is actually being performed by the individual can be accomplished by determining when during the representative, defined time period more than one optional action has been performed in a particular time frame. More than one optional action being performed in a particular time frame, in some embodiments, above a threshold number of times for each optional action (e.g., twice) can be used as a determinant to further define when the activity being monitored is actually being consistently performed by the individual.

For example, as illustrated in graph 200, in the contiguous time frames from the beginning of hour 8 through the end of hour 11, at least two optional actions have each been performed at least twice. As shown in the time frame between hour 8 and hour 9, the individual has performed one or more actions that activated sensors indicating presence in the kitchen 203 ten times during the defined time period and the individual also has performed one or more actions that activate sensors indicating opening of one or more cabinets in the kitchen 206 ten times during the defined time period.

Similar multiple occurrences of more than one optional actions associated with taking nourishment are shown to activate appropriate sensors in the time frames until the end of hour 11. For example, as shown in the time frame between hour 10 and the start of hour 11, the individual has performed one or more actions that activated sensors indicating presence in the kitchen 203 six times during the defined time period and the individual also has performed one or more actions that activate one or more sensors indicating opening the refrigerator in the kitchen 209 nine times during the defined time period. As such, a reliable deduction may be made that the individual being monitored consistently takes morning nourishment (e.g., breakfast) in a time window from the beginning of hour 8 until the end of hour 11.

In contrast, time frames in which the individual's presence in the kitchen is detected by one or more sensors during the defined time period without coincident detection of activation of optional indicators of taking nourishment may be indicative of the individual performing activities other than taking nourishment (e.g., visiting with a neighbor). As such, detection of only one indicator of optional activity associated with a particular activity (e.g., taking nourishment) can be unreliable as a determinant for a time window enabling reliable monitoring of performance of the particular activity.

For example, as illustrated in graph 200, although an individual's presence in the kitchen has been detected by sensors 203 many times from the beginning of hour 12 through the end of hour 13 (i.e., a total frequency of 21 activations), none of the other optional indicators of taking nourishment was detected even once during those two time frames during the representative, defined time period. As such, it may be deduced from such an analysis that inclusion of the time frames that cover the beginning of hour 12 through the end of hour 13 is unnecessary for determining a reliable time window for monitoring taking morning nourishment by an individual. That is, just because an individual (who may not be the actual individual intended to be monitored) is regularly in the kitchen during a particular time frame can be insufficient for deducing that the individual being monitored is taking nourishment during that time frame without coincident detection of a number of optional actions associated with taking nourishment.

Similarly, the lime frames in graph 200 from the beginning of hour 16 through the end of hour 18 each include an occurrence of at least two optional actions associated with taking nourishment that each have been detected at a frequency of at least two activations of the appropriate sensors. For example, in the time frame from the beginning through the end of hour 16, activation of the one or more sensors indicating the presence of an individual in the kitchen 203 occurred sixteen times, the individual performed one or more actions that activate sensors indicating opening of one or more cabinets in the kitchen 206 twelve times, and the individual also has performed one or more actions that activate one or more sensors indicating opening the refrigerator in the kitchen 209 two times during the defined time period.

In contrast, the time frame from the beginning through the end of hour 15 in graph 200 only documents activation of the one or more sensors indicating presence of an individual in the kitchen 203 one time, along with activation of no other sensors, and the time frame from the beginning of hour 19 through the end of hour 19 documents activation of the one or more sensors indicating presence of an individual in the kitchen 203 seven times, also along with activation of no other sensors. As described in the present disclosure, a time window for monitoring the individual taking late afternoon nourishment (e.g., dinner/supper) can be deduced from analysis of graph 200, where the time window extends from the beginning of hour 16 through the end of hour 19.

In addition, a time window for taking nourishment later in the day (e.g., an evening snack) can be deduced from analysis of graph 200. That is, during the two time frames extending from the beginning of hour 20 through the end of hour 21, graph 200 documents activation of the one or more sensors indicating the presence of an individual in the kitchen 203 a total of four times, and that the individual also has performed one or more actions that activate one or more sensors indicating opening the refrigerator in the kitchen 209 a total of six times during the defined time period. As described in the present disclosure, a time window for monitoring the individual taking evening/night nourishment can be deduced from analysis of graph 200, where the time window extends from the beginning of hour 20 through the end of hour 21.

In some embodiments of the present disclosure, an equation can be derived (e.g., using a least-squares fit to create a curve based on a third- or higher-order polynomial) from analysis of frequencies of combinations of sensor activations allocated to particular time frames, which, by way of example and not by way of limitation, can utilize analysis of raw data or a graph, such as graph 200. In various embodiments such an equation can use the hour values on the horizontal axis as x values in the equation and the frequency values on the vertical axis as the y values in the equation.

Such an equation may correlate the peaks in the frequency of a particular recurrent activity, as determined, for example, by an elevated magnitude of the combined frequency of activation of appropriate sensors, with the particular time frame, or time frames, during which such peaks in the frequency of the particular recurrent activity occur. Similarly, the equation may correlate the valleys in the frequency of the particular recurrent activity, as determined, for example, by a lesser magnitude of the combined frequency of activation of appropriate sensors, with the particular time frame, or time frames, during which such valleys in the frequency of the particular recurrent activity occur.

The type of equation that may be derived, as will be appreciated by one of ordinary skill in the relevant art, may be, for example, of the form: $y=3x^4-4x^3-12x^2+3$. In various embodiments, numbers inserted as the x variable can represent particular time frames in the time period being analyzed and the y variable can represent, for example, the combined frequency of occurrence of the particular recurrent activity in a particular time frame, as detected by activation of one or more sensors associated with performance of the activity.

As will further be appreciated by one of ordinary skill in the relevant art, a first derivative can be obtained from an equation such as $y=3x^4-4x^3-12x^2+3$ (or, as alternatively expressed, a function: $f'(x)\ 3x^4-4x^3-12x^2+3$) using differential calculus. Such a first derivative (e.g., $f'(x)=12x^3-12x^2-24x$ when applied to the just-recited example function) can be used to determine whether a number of critical points (e.g., where a slope of a line representing the function in a graph equals zero) are individually associated with peaks or valleys in a graphic representation of the function.

In addition, as will be appreciated by one of ordinary skill in the relevant art, a second derivative also can be obtained (e.g., from the function $f(x)\ 3x^4-4x^3-12x^2+3$, or the first derivative $f'(x)=12x^3-12x^2-24x$) using differential calculus. Such a second derivative (e.g., $f'(x)=36x^2-24x-24$ when applied to the just-recited example functions) can be used to determine whether a particular critical point (e.g., where $f'(x)=0$) represents a local maximum of the function (e.g., an apex of a peak region) or a local minimum of the function (e.g., a nadir of a valley region) in a graphic representation of the function.

Hence, as described in the present disclosure, monitoring a recurrent activity of an individual can be performed with a number of sensors for detecting actions associated with performance of a number of recurrent activities by the individual, where at least some of the number of sensors are located in a residence of the individual. In various embodiments, a logic component can be in communication with the number of sensors.

The logic component can include instructions that are executable by a device to perform monitoring, by using at least one of the number of sensors and an associated timer, frequencies of the performance of the number of recurrent activities, where the frequencies are identified by activations of the at least one of the number of sensors partitioned into a sequence of particular time frames covering a defined time period. Instructions included in the logic component also can be executed for deriving at least one equation that substantially represents the individual frequencies of the number of recurrent activities partitioned into the sequence of particular time frames covering the defined time period.

Such an equation can be used by the logic component for deriving a first derivative for the at least one equation to identify peaks and valleys in the frequencies of the performance of at least one recurrent activity and obtaining activity performance information corresponding to the identified peaks and valleys in the frequencies of the performance of the at least one recurrent activity. The instructions included in the logic component can be executed for adjusting, based on the activity performance information, which of the sequence of particular time frames covering the defined time period are monitored for frequencies of the performance of the at least one recurrent activity.

In some embodiments, adjusting which of the sequence of particular time frames are monitored can include creating a number of time windows for focused monitoring of the frequency of performance of the at least one activity. In various embodiments, the number of time windows can encompass at least a portion of: a number of identified peaks in the frequencies of the performance of the at least one recurrent activity; and/or a number of identified valleys in the frequencies of the performance of the at least one recurrent activity.

In some embodiments, a second derivative can be derived for the at least one equation to identify an apex for at least one of the peaks and/or a nadir for at least one of the valleys in the frequencies of the performance of at least one recurrent activity. Identifying the apex for the at least one of the peaks and the nadir for the at least one of the valleys can include identifying which particular times are at the apex for the at least one of the peaks and/or which particular times are at the nadir for the at least one of the valleys in the frequencies. In various embodiments, identifying which particular times are at the apex for the at least one, of the peaks and/or which particular times are at the nadir for the at least one of the valleys in the frequencies can include one or more of: fractions of hours during a 24-hour day; hours during the 24-hour day; time periods during the 24-hour day, which are determined as multiple fractions of hours and multiple hours during the day; time periods during the 24-hour day, where the time periods have differing lengths; 24-hour days during a number of 7-day weeks; 7-day weeks during a number of months; and/or months during a year.

Adjusting which of the sequence of particular time frames are monitored can, in various embodiments, include creating a number of time windows for focused monitoring of the frequency of performance of the at least one activity, where the number of time windows can encompass at least one of: a number of identified apices in the frequencies of the performance of the at least one recurrent activity; and/or a number of identified nadirs in the frequencies of the performance of the at least one recurrent activity. For example, a window can be defined with an apex at the center of the window and/or with the edges of the window at one or more nadir points or near nadir points, among other window configurations.

Detecting actions associated with performance of at least one of the number of recurrent activities by the individual can, in various embodiments, include using a number of sensors selected from a group that includes, as appreciated by one of ordinary skill in the relevant art, one or more of: a motion sensor; a water low sensor; a sound sensor; a visible light sensor; an infrared light sensor; an ultraviolet light sensor; a vibration sensor; a pressure sensor; a temperature sensor; an accelerometer; and/or an inclinometer; among other possible types of sensors. In various embodiments, one or more of each type of sensor can be used to detect indicators of performance of a particular activity by activation of at least one of the sensors. In various embodiments, one or more sensors of more than one type of sensor can be combined to form a group of sensors for detecting indicators of more than one type of action associated with an individual performing a particular activity.

In some embodiments of the present disclosure, a system for monitoring a recurrent activity can include a number of sensors to detect performance of a particular recurrent activity by an individual. Detecting performance of the particular recurrent activity can be accomplished, in various embodiments, using two or more (i.e., a plurality of) subsets of the number of sensors (e.g., sensors 112-1, 112-2, . . . 112-N) to form a group of sensors, where at least one subset of the sensors is activatable by sensing an indicator associated with performance of the particular recurrent activity that is different from an indicator sensed by the other subsets of the number of sensors.

The logic component, as discussed above with respect to FIG. 1, can be included in the system, for example, in order to: initiate a timer to enable recording activations of the plurality of sensor subsets in a time period, where, in some embodiments, the frequencies of the activations can be partitioned into a sequence of particular time frames in the time period; define one or more time frames in the time period; institute at least one rule for determining whether to initiate an action based upon a combined frequency of the activations of the plurality of subsets of the number of sensors in the one or more time frames; and determine initiation of the action based upon whether the at least one rule has been met. In various embodiments, the plurality of subsets of sensors can include a first subset of sensors that is activatable during performance of a daily living activity and at least a second subset that is activatable during performance of the daily living activity, where the first subset and the second subset are optionally activatable by sensing different indicators of performance of the daily living activity.

In some embodiments, the system can include combined monitoring of the plurality of subsets and activation of a sensor in the first optionally activatable subset is indicative of performance of the daily living activity even in absence of activation of a sensor in the second optionally activatable subset. For example, when one or more sensors are installed in a kitchen such that they are activated by use of a stove and/or oven, activation thereof can, in some embodiments, be indicative of taking nourishment even when no other sensors are activated by actions associated with taking nourishment (e.g., sensors that detect indicators of opening a cabinet, a refrigerator, among other actions).

The combined monitoring of the plurality of subsets can, in some embodiments, include monitoring a plurality of optionally activatable subsets for sensing different indicators, where at least one sensor in the plurality of subsets is activated by variations in performance of the daily living activity. By way of example and not by way of limitation, at least one sensor can, in various embodiments, be included in the plurality of subsets (e.g., a group of sensors for detecting performance of a particular activity) that is activatable by sensing a stove and/or oven radiating heat for greater than a defined length of time, sensing a bathing utility in a bathroom running water for greater than a defined length of time, sensing pressure in a bed for greater than a defined length of time, among other indicators of variations in performance of daily living activities.

In some embodiments, sensing such an indicator by itself can be used as a rule for determining whether to initiate an action based upon identified activations of the plurality of subsets of the number of sensors, and sensing such an indicator by itself can determine initiation of the action based upon whether the at least one rule has been met. For example, the action to be initiated may be to contact a neighbor, medical personnel, or others capable of providing assistance, and/or attempt to contact the individual whose activities are being monitored.

In various embodiments of the present disclosure, monitoring the plurality of optionally activatable subsets can include positioning the sensors of the plurality of optionally activatable subsets in one or more locations associated with performance of the daily living activity, where the one or more locations can, among other locations, include: a kitchen that includes one or more areas for preparing food and storing food (e.g., having utilities such as a stove, oven, refrigerator, cabinets, microwave, etc.); a lavatory that includes a toilet area (e.g., having utilities such as a toilet, bidet, etc.); a bathroom that includes a bathing area (e.g., having utilities such as a shower, bathtub, sink, bidet, etc.); a bedroom that includes a sleeping area (e.g., having furniture such as a bed, cot, lounge chair, hammock, etc.); a medicine storage area (e.g., having items such as a medicine cabinet, locker, pill dispenser, etc.); a living room that includes one or more relaxation areas (e.g., having furniture such as a couch, chair, foldout bed, lounge chair, love seat, etc.); a living room that includes one or more entertainment areas (e.g., having components such as a television, music center, radio, set-top box, board games, electronic games, etc.); a thermostat (e.g., that enables control of environmental temperature, air circulation by fan operation, humidity, etc.); a doorway (e.g., that allows ingress and egress from a residence); a window (e.g., that allows control of air circulation in the residence); a trash container (e.g., that facilitates collection and removal of waste); a space that facilitates access to a utility that enables transport of the individual to and from the residence (e.g., such as a garage containing an automotive vehicle, a cab stand, a bus stop, etc.); a utility that allows the individual to access information from an entity outside the residence (e.g., such as a computer connected to the Internet, television, radio, mail insert slot, newspaper insert slot, etc.); a utility that allows the individual to communicate with an entity outside the residence (e.g., such as a computer with e-mail exchange connection, mobile telephone with text messaging capability, landline telephone, walky-talky, shortwave radio, mailbox, etc.); and/or a hallway that allows access to one or more of the preceding areas, locations, furniture, items, and/or utilities, among others.

Monitoring a plurality of optionally activatable subsets can, in various embodiments, include analyzing two or more of the subsets together, for instance, to provide a more robust determination of performance of the daily living activity than provided by analysis of a single optionally activatable subset. For example, as described in the present disclosure, detecting a combination of all individual's presence in a kitchen, opening of one or more cabinets where food is stored, and/or opening of a refrigerator where food is cooled and/or frozen (possibly, in combination with other indicators such as use of a stove and/or oven, etc.) can provide a more reliable determination that the individual is taking nourishment than detection of any single indicator alone.

In some instances, the reliability can be increased because each single indicator may or may not be present when the individual is performing the activity, along with each of the actions possibly being performed to accomplish a different activity. For example, the individual may be in the kitchen to meet with friends and/or family, the cabinets may be opened to insert food containers following purchase, among other optional activities that are not definitive of a single activity.

Figure 3:
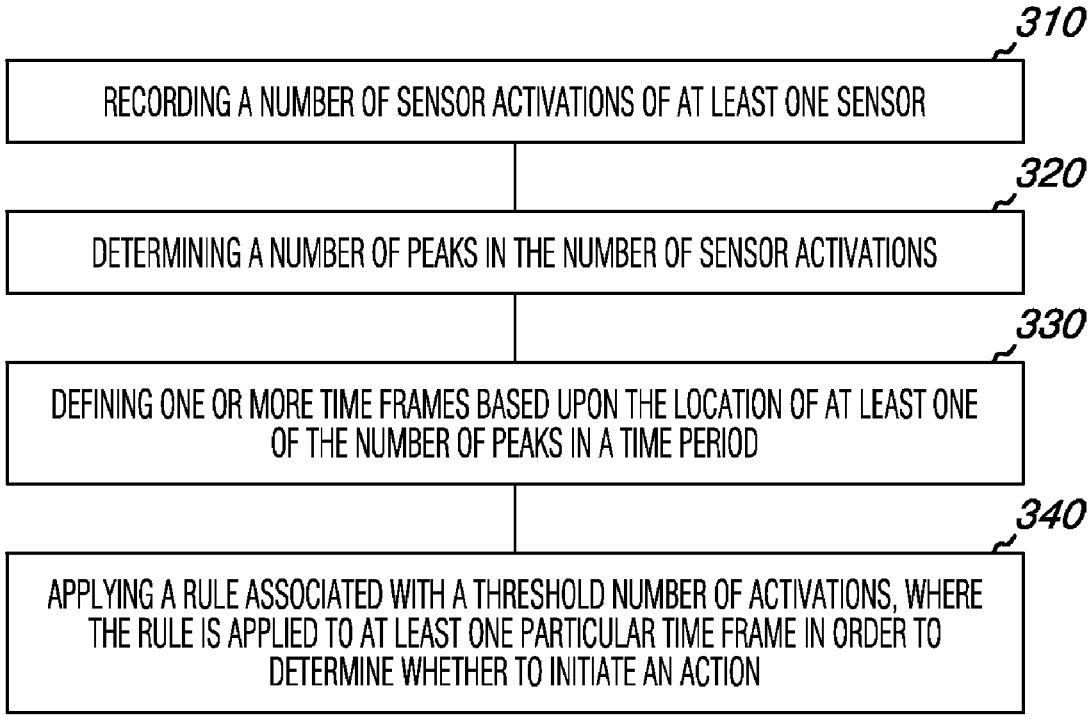
FIG. 3 is a block diagram illustrating a method for monitoring a recurrent activity of an individual using activity windowing according to the present disclosure.

FIG. 3 is a block diagram illustrating a method for monitoring a recurrent activity of an individual using activity windowing according to the present disclosure. Unless explicitly stated, the method embodiments described herein are not constrained to a particular order or sequence. Additionally, some of the described method embodiments, or elements thereof, can occur or be performed at the same, or at least substantially the same, point in time.

Method embodiments can be executed by one or more logic components such as a printed circuit board, a Flash drive, and/or an ASIC, among other such implementations, and/or by computing device-executable instructions stored on software and/or firmware, and the like. A system implementing embodiments of the methodology can be used in determining whether to initiate, as described in the present disclosure, an action based upon whether a requirement of a rule has been met.

The embodiment illustrated in FIG. 3 includes recording a number of sensor activations of at least one sensor, as shown in block 310. In various embodiments, recording a number of sensor activations of at least one sensor can be accomplished by monitoring a number of sensors to identify activations of at least one sensor associated with the individual performing a particular recurrent activity. As described in the present disclosure, one or more of various type of sensors that detect indicators of various different actions being performed can, in some embodiments, be included in a group to provide a more robust determination of performance of the particular recurrent activity than provided by analysis of a single optionally activatable sensor or sensors that detect a single indicator associated with performance of the activity.

Block 320 of FIG. 3 shows that monitoring a recurrent activity using activity windowing can include determining a number of peaks in the number of sensor activations. In various embodiments, determining a number peaks in the number of sensor activations can be accomplished by analysis of the frequencies of the identified activations of the at least one sensor during a defined time period. For example, in some embodiments, the number of frequencies can be recorded in a graphical display, as illustrated in FIG. 2, from which the number of peaks in sensor activations can be determined. In some embodiments, such a determination can be performed using memory upon which mathematical (e.g., calculus) manipulations may be performed.

As shown in block 330, monitoring a recurrent activity using activity windowing can include defining one or more time frames based upon the location of at least one of the number of peaks in a time period. In various embodiments, defining a plurality of time frames can be accomplished by partitioning the defined time period into a sequence of particular time frames. In some embodiments, the size and/or boundaries of the time frames can be determined using a first derivative test and/or a second derivative test, as described in the present disclosure.

Monitoring a recurrent activity using activity windowing can include applying a rule associated with a threshold number of activations, where the rule is applied to at least one particular time frame in order to determine whether to initiate an action, as shown in block 340. For example, in various embodiments, determination of frequencies of a particular activity allocated to sequential time frames over a representative, defined time period can contribute to a determination that the frequency of occurrence of the particular activity reaches a number of peaks within a number of particular time windows (e.g., that include one or more particular time frames).

A rule based upon the peaks can, for example, be formed based thereon where at least a certain number of sensor activations occurs in the future (e.g., after the frequencies of sensor activations have been determined for the number of peaks in the defined, representative time period) within the particular time frames (i.e., a time window) in order to prevent initiation of a resulting potential action (e.g., notifying a third party). In various embodiments, certain numbers of sensor activations can be selected within each of the number of particular time windows to serve as thresholds that are met to prevent initiation of a resulting potential action.

Each of the thresholds can have a particular value that is derived from (e.g., a fraction, percentage, and/or proportion, among other ways of determining the threshold value) the frequency of sensor actions in each of the time windows representing the peaks in occurrence frequency. Such a threshold can serve as a maximum frequency not to be exceeded or a minimum frequency that is exceeded in order to prevent or allow initiation of the resulting potential action.

In some embodiments of the present disclosure, a number of valleys can be determined in the number of sensor activations. That is, in some embodiments, determination of a number of valleys can be accomplished by analyzing the frequencies of the identified sensor activations in the defined time period. For example, the number of valleys can be determined using the first derivative test, as described in the present disclosure.

In some embodiments, monitoring a recurrent activity using activity windowing can include defining one or more time frames based upon the location of at least one of the number of valleys in the time period. In various embodiments, defining a plurality of time frames can be accomplished by partitioning the defined time period into a sequence of particular time frames. In some embodiments, the size and/or boundaries of the time frames can be determined using a first derivative test and/or a second derivative test, as described in the present disclosure.

Monitoring a recurrent activity using activity windowing can include applying a rule associated with a threshold number of activations, where the rule is applied to at least one particular time frame in order to determine whether to initiate an action. For example, in various embodiments, determination of frequencies of a particular activity allocated to sequential time frames over an representative, defined time period can contribute to a determination that the frequency of occurrence of the particular activity reaches the frequency in a number of valleys within a number of particular time windows (e.g., that include one or more particular time frames).

A rule based upon the valleys can, for example, be formed based thereon where at most a certain number of sensor activations occurs in the future (e.g., after the frequencies of sensor activations have been determined for the number of valleys in the defined, representative time period) within the particular time frames (i.e., a time window) in order to prevent initiation of a resulting potential action (e.g., notifying a third party). In various embodiments, certain numbers of sensor activations can be selected within each of the number of particular lime windows to serve as thresholds that are met to prevent or allow initiation of a resulting potential action.

Each of the thresholds can have a particular value that is derived from (e.g., a fraction, percentage, and/or proportion, among other ways of determining the threshold value) the frequency of sensor actions in each of the time windows representing the valleys in occurrence frequency. Such a threshold can serve as a maximum frequency not to be exceeded or a minimum frequency that is exceeded in order to prevent or allow initiation of the resulting potential action.

In various embodiments, covering a defined time period for recording the number of frequencies partitioned into the sequence of particular time frames (e.g., which can contribute to determination of time windows) can utilize time frames determined in a number of ways (e.g., having a range of lengths). Examples of various time frame embodiments as described in the present disclosure can include: sequential fractions of hours during a 24-hour day; sequential hours during the 24-hour day; sequential time periods during the 24-hour day, which are determined as multiple fractions of hours and multiple hours during the clay; sequential time periods during the 24-hour day, where the time periods have differing lengths; sequential 24-lour days during a number of 7-day weeks; sequential 7-day weeks during a number of months; and/or sequential months during a year.

In some embodiments, covering the defined time period does not include covering every sequential time frame in a day, week, year, etc. That is, in various embodiments, one or more sequences of particular time frames (e.g., where a particular sequence can include a single time frame or multiple time frames) can be selected for monitoring the occurrence of a particular activity (e.g., a time window) that can exclude monitoring of other time frames (e.g., outside the time window). That is, for example, covering the defined time period can include recording a number of frequencies partitioned into a sequence of particular time frames where the time frames can, in various embodiments, include one or more of: designated fractions of hours during a 24-hour day; designated hours during the 24-hour day; designated time periods during the 24-hour day, which are determined as multiple fractions of hours and multiple hours during the 24-hour day; designated time periods during the 24-hour day, where the time periods have differing lengths; designated days of the week during a number of 7-day weeks; designated 7-day weeks during a number of months; and/or designated months during a year.

As described in the present disclosure, recording the number of sensor activations of the at least one sensor can include recording the number of sensor activations in a number of ways. For example, recording the number of sensor activations can be performed by, recording total activations of the at least one sensor, for instance, associated with each of the particular time frames; recording total activations of the at least one sensor associated with a plurality of the particular time frames that form a time window; recording average activations of the at least one sensor associated with the plurality of the particular time frames that form the time window; recording total lengths of time of the activations of the at least one sensor associated with each of the particular time frames; recording total lengths of time of the activations of the at least one sensor associated with the plurality of the particular time frames that form the time window; and/or recording average lengths of time of the activations of the at least one sensor associated with the plurality of the particular time frames that form the time window.

Monitoring a recurrent activity using activity windowing as described in the present disclosure can, in various embodiments, include adjusting, based on determination of the peak-s and valleys, which of the sequence of particular time frames in the defined time period are monitored for frequencies of performance of the particular recurrent activity. For example, a determination can be made that monitoring the recurrent activity can be performed more efficiently in the future when the frequencies of the performance of the activity are monitored during one or more sequences of time frames (where a sequence of time frames can include a single time frame or multiple time frames) that corresponded to peaks and/or valleys in frequencies of the performance of the particular recurrent activity previously recorded during the defined time period. Based upon such a determination, one or more time windows can, in various embodiments, be determined for monitoring the frequencies of the performance of the particular recurrent activity.

Monitoring a recurrent activity as described in the present disclosure can, in various embodiments, include utilizing a number of timers for recording the number of activations of the at least one sensor. For example, one or more timers can assist in controlling initiating and/or ending of recording the number of frequencies of the identified activations of the at least one sensor. In some embodiments, for example, a first timer can be associated with control of a first number of sensors and a second timer can be associated with control of a second number of sensors. In some embodiments, the first and second numbers of sensors can be utilized in detecting indicators of performance of different types of recurrent activities.

Although specific embodiments have been illustrated and described herein, those of ordinary skill in the relevant art will appreciate that any arrangement calculated to achieve the same techniques can be substituted for the specific embodiments shown and, nonetheless, be covered by the present disclosure. That is, this disclosure is intended to cover any and all adaptations and/or variations off various embodiments of the disclosure. As one of ordinary skill in the relevant art will appreciate upon reading this disclosure various embodiments of the disclosure can be performed in one or more devices, device types, and system environments, including networked environments.

It is to be understood that the use of the terms "a", "an", "one or more", "a number of", or "at least one" are all to interpreted as meaning one or more of an item is present, while "a plurality of" is to be interpreted as meaning more than one of an item is present. Additionally, it is to be understood that the above description has been made in an illustrative fashion, and not a restrictive one.

Combination of the above embodiments, and other embodiments not specifically described herein will be apparent to those of ordinary skill in the relevant art upon reviewing the above description. The scope of the various embodiments of the disclosure includes other applications in which the above structures and methods can be used. Therefore, the scope of various embodiments of the disclosure should be determined with reference to the appended claims, along with the full range of equivalents to which such claims are entitled.

In the foregoing Detailed Description, various features are grouped together in a single embodiment for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A method for monitoring a recurrent activity of an individual using activity windowing, comprising:

recording a number of sensor activations of at least one sensor;

determining a number of peaks in the number of sensor activations;

defining one or more time frames based upon a location of at least one of the number of peaks in a time period determining a number of valleys in the number of sensor activations;

defining one or more time frames based upon the location of at least one of the number of valleys in a time period; and applying a rule associated with a threshold number of activations, where the rule is applied to at least one particular time frame in order to determine whether to initiate an action.

2. The method of claim 1, where the time frames include one or more of:

sequential fractions of hours during a 24-hour day;

sequential hours during the 24-hour day;

sequential time periods during the 24-hour day, which are determined as multiple fractions of hours and multiple hours during the day;

sequential time periods during the 24-hour clay, where the time periods have differing lengths;

sequential 24-hour days during a number of 7-day weeks;

sequential 7-day weeks during a number of months; and sequential months during a year.

3. The method of claim 1, where the time frames include one or more of:

designated fractions of hours during a 24-hour day;

designated hours during the 24-hour day;

designated time periods during the 24-hour day, which are determined as multiple fractions of hours and multiple hours during the 24-hour day;

designated time periods during the 24-hour day, where the time periods have differing lengths;

designated days of the week during a number of 7-day weeks;

designated 7-day weeks during a number of months; and designated months during a year.

4. The method of claim 1, where recording the number of sensor activations of the at least one sensor includes:

recording total activations of the at least one sensor;

recording total activations of the at least one sensor associated with a plurality of the particular time frames that form a time window;

recording average activations of the at least one sensor associated with the plurality of the particular time frames that form the time window;

recording total lengths of time of the activations of the at least one sensor associated with each of the particular time frames;

recording total lengths of time of the activations of the at least one sensor associated with the plurality of the particular time frames that form the time window; and recording average lengths of time of the activations of the at least one sensor associated with the plurality of the particular time frames that form the time window.

5. The method of claim 1, where the method includes adjusting, based on determination of the peaks and valleys, which of the sequence of particular time frames in the time period are monitored for frequencies of performance of a particular recurrent activity.

6. The method of claim 1, wherein the method includes utilizing a number of timers for recording the number of activations of the at least one sensor.

7. A system for monitoring a recurrent activity, comprising:

a number of sensors to detect performance of a particular recurrent activity by an individual;

a plurality of subsets of the number of sensors, where at least one subset of the sensors is activatable by sensing an indicator associated with performance of the particular recurrent activity that is different from an indicator sensed by another subset of the number of sensors;

a logic component to:

initiate a timer to enable recording activations of the plurality of sensor subsets in a time period;

define one or more time frames in the time period;

institute at least one rule for determining whether to initiate an action based upon a combined frequency of the activations of the plurality of subsets of the number of sensors in the one or more time frames; and determine initiation of the action based upon whether the at least one rule has been met.

8. The system of claim 7, where the plurality of subsets includes a first subset of sensors that is activatable during performance of a daily living activity and at least a second subset that is activatable during performance of the daily living activity, where the first subset and the second subset are optionally activatable by sensing different indicators of performance of the daily living activity.

9. The system of claim 8, where the system includes combined monitoring of the plurality of subsets and activation of a sensor in the first optionally activatable subset is indicative of performance of the daily living activity even in absence of activation of a sensor in the second optionally activatable subset.

10. The system of claim 8, where the combined monitoring of the plurality of subsets includes monitoring a plurality of optionally activatable subsets for sensing different indicators, where at least one sensor in the plurality of subsets is activated by variations in performance of the daily living activity.

11. The system of claim 10, where monitoring the plurality of optionally activatable subsets includes positioning the sensors of the plurality of optionally activatable subsets in one or more locations associated with performance of the daily living activity, where the one or more locations are selected from a group that includes:

a kitchen area;

a lavatory that includes a toilet area;

a bathroom that includes a bathing area;

a bedroom that includes a sleeping area;

a medicine storage area;

a living room that includes a relaxation area;

a living room that includes an entertainment area;

a thermostat;

a doorway;

a window;

a trash container;

a space that facilitates access to a utility that enables transport of the individual to and from the residence;

a utility that allows the individual to access information from an entity outside the residence;

a utility that allows the individual to communicate with an entity outside the residence; and a hallway that allows access to one or more of the preceding.

12. The system of claim 10, where monitoring a plurality of optionally activatable subsets includes analyzing two or more of the subsets together.

13. A system for monitoring recurrent activities of an individual, comprising:

a number of sensors for detecting actions associated with performance of a number of recurrent activities by the individual, where at least some of the number of sensors are located in a residence of the individual; and a logic component in communication with the number of sensors, the logic component including instructions executable by a device to perform a method that includes:

monitoring, by using at least one of the number of sensors and an associated timer, frequencies of the performance of the number of recurrent activities, where the frequencies are identified by activations of the at least one of the number of sensors partitioned into a sequence of particular time frames covering a defined time period;

deriving at least one equation that substantially represents the individual frequencies of the number of recurrent activities partitioned into the sequence of particular time frames covering the defined time period;

deriving a first derivative for the at least one equation to identify peaks and valleys in the frequencies of the performance of at least one recurrent activity;

obtaining activity performance information corresponding to the identified peaks and valleys in the frequencies of the performance of the at least one recurrent activity; and adjusting, based on the activity performance information, which of the sequence of particular time frames covering the defined time period are monitored for frequencies of the performance of the at least one recurrent activity.

14. The system of claim 13, where adjusting which of the sequence of particular time frames are monitored includes creating a number of time windows for focused monitoring of the frequency of performance of the at least one activity, where the number of time windows encompass at least a portion of:

a number of identified peaks in the frequencies of the performance of the at least one recurrent activity; and a number of identified valleys in the frequencies of the performance of the at least one recurrent activity.

15. The system of claim 13, where the method includes deriving a second derivative for the at least one equation to identify an apex for at least one of the peaks and a nadir for at least one of the valleys in the frequencies of the performance of at least one recurrent activity.

16. The system of claim 15, where identifying the apex for at least one of the peaks and the nadir for at least one of the valleys includes identifying at least one of which particular times are at the apex for the at least one of the peaks and which particular times are at the nadir for the at least one of the valleys in the frequencies.

17. The system of claim 16, where identifying at least one of which particular times are at the apex for the at least one of the peaks and which particular times are at the nadir for the at least one of the valleys in the frequencies includes one or more of:

fractions of hours during a 24-hour day;

hours during the 24-hour day;

time periods during the 24-hour day, which are determined as multiple fractions of hours and multiple hours during the day;

time periods during the 24-hour day, where the time periods have differing lengths;

24-hour days during a number of 7-day weeks;

7-day weeks during a number of months; and months during a year.

18. The system of claim 17, where adjusting which of the sequence of particular time frames are monitored includes creating a number of time windows for focused monitoring of the frequency of performance of the at least one activity, where the number of time windows encompass at least one of:

a number of identified apices in the frequencies of the performance of the at least one recurrent activity; and a number of identified nadirs in the frequencies of the performance of the at least one recurrent activity.

19. The system of claim 13, where detecting actions associated with performance of at least one of the number of recurrent activities by the individual includes using a number of sensors selected from a group that includes:

a motion sensor;

a water flow sensor;

a sound sensor;

a visible light sensor;

an infrared light sensor;

an ultraviolet light sensor;

a vibration sensor;

a pressure sensor;

a temperature sensor;

an accelerometer; and an inclinometer.

* * * * *